US010059486B2

(12) United States Patent
Kassouni

(10) Patent No.: US 10,059,486 B2
(45) Date of Patent: Aug. 28, 2018

(54) SHIPPING CONTAINER AND INSERT

(71) Applicant: Van M. Kassouni, Grand Rapids, MI (US)

(72) Inventor: Van M. Kassouni, Grand Rapids, MI (US)

( * ) Notice: Subject to any disclaimer, the term of this patent is extended or adjusted under 35 U.S.C. 154(b) by 617 days.

(21) Appl. No.: 14/226,026

(22) Filed: Mar. 26, 2014

(65) Prior Publication Data

US 2015/0274414 A1 Oct. 1, 2015

(51) Int. Cl.
*B65D 88/00* (2006.01)
*B65D 5/72* (2006.01)
*B65D 5/16* (2006.01)

(52) U.S. Cl.
CPC ..... *B65D 5/724* (2013.01); *B65D 5/16* (2013.01); *B65D 2231/008* (2013.01)

(58) Field of Classification Search
CPC ..... B65D 77/06
USPC ..... 220/1.5, 1.6
See application file for complete search history.

(56) References Cited

U.S. PATENT DOCUMENTS 2,330,348 A 9/1943 Elliott
2,620,119 A 12/1952 George
3,171,449 A 3/1965 Ellms et al.
4,541,765 A * 9/1985 Moore ..... B65D 88/62 220/1.6
4,767,035 A 8/1988 Jacobi
4,890,787 A 1/1990 Liebel
5,638,988 A 6/1997 Rogers et al.
6,220,507 B1 4/2001 Guillin
8,104,997 B2 1/2012 Maguire
8,505,590 B2 8/2013 Kernkamp et al.
2004/0118725 A1* 6/2004 Shuert ..... B65D 19/0028 206/386
2009/0008405 A1 1/2009 Mathus et al.
2009/0255946 A1* 10/2009 Rose ..... B65D 5/46016 220/754

(Continued)

FOREIGN PATENT DOCUMENTS

EP 0070721 1/1983
GB 2283008 4/1995
WO WO1997042078 11/1997

OTHER PUBLICATIONS

International Search Report and Written Opinion dated Mar. 23, 2015 for corresponding PCT Application No. PCT/US2015/021935.

*Primary Examiner* — Andrew T Kirsch
*Assistant Examiner* — Don M Anderson
(74) *Attorney, Agent, or Firm* — Gardner Linn

(57) ABSTRACT

A shipping container for transporting bulk particulate material includes an outer container and an inner container with tapered sides that taper or narrow downward towards a bottom portion of the inner container. As a vacuum removes particulate material from at the bottom portion of the inner container, material higher up in the outer container and/or inner container funnels downward towards a central region at the bottom portion of the inner container and near the mouth of the vacuum tube or hose, filling a void created by the extracted material that is drawn up the tube or hose. The inner container provides a continuous flow of material to the vacuum hose or tube and a more complete emptying of the container, without having to tilt the shipping container or move the vacuum hose or tube in the shipping container.

5 Claims, 13 Drawing Sheets

(56) References Cited

U.S. PATENT DOCUMENTS

| | | | | |
|---|---|---|---|---|
| 2011/0017731 | A1* | 1/2011 | Taravella | B65D 5/029 220/4.28 |
| 2012/0132650 | A1* | 5/2012 | Buonerba | B60P 3/426 220/1.6 |
| 2012/0269587 | A1 | 10/2012 | Maguire | |

* cited by examiner

SHIPPING CONTAINER AND INSERT

FIELD OF THE INVENTION

The present invention relates generally to shipping containers and, more particularly, to shipping containers for transporting bulk material in particulate form.

BACKGROUND OF THE INVENTION

Large cardboard containers such as Gaylord boxes are a popular method of transporting bulk material in particulate form, such as in the shipping of powdered metals, pelletized plastic resin or the like. Automatic removal can be accomplished with a lance or pickup wand attached via a flexible hose to a vacuum loader, whereby the wand is inserted into the box from above to vacuum the particulates up and out of the box. Large tilt tables or tippers have been developed to aid in the flow of material toward the lance.

SUMMARY OF THE INVENTION

The present invention provides a shipping container assembly for bulk particulate material. The assembly has both an outer shipping container and an insert or inner construction or inner container portion or inner funnel-shaped portion. The outer container has a container inner storage cavity defined by a base and sidewalls. The inner container portion has an upper portion, a lower portion, and a wall extending between the upper portion and the lower portion. The inner container portion is configured to fit within the inner storage cavity of the container so that the upper portion of the insert contacts the wall of the outer container (or the inner container portion may be formed as part of the overall container, such as via using a portion of the sidewalls of the outer container to form or establish the inner container portion). The inner container portion's lower portion and side wall define a second inner storage cavity of the container, which also holds particulate material. The lower portion has a smaller cross section than the upper portion, with the sidewalls of the inner container portion that extend between the upper and lower portions creating a tapered side wall that allows particulate material to funnel to a central location at the lower portion of the inner container portion for extraction from the shipping container, such as via gravity or a vacuum device or the like.

Therefore, the present invention provides an enhanced shipping container that provides a tapered funnel configuration inside the container to ease extraction of the particulate material from the shipping container. The insert or inner container portion may be part of the outer shipping container or may be a separate element that is inserted into the shipping container and retained therein before the particulate material is loaded into the shipping container. The shipping container and insert of the present invention allow for easier extraction of particulate material from the shipping container, without having to insert a vacuum wand from above into the shipping container and/or without having to tilt the shipping container to assist in unloading or extracting the particulate material, such as when there is not much of the material left in the container.

These and other objects, advantages, purposes and features of the present invention will become more apparent upon review of the following specification in conjunction with the drawings.

DESCRIPTION OF THE PREFERRED EMBODIMENTS

Figure 1:
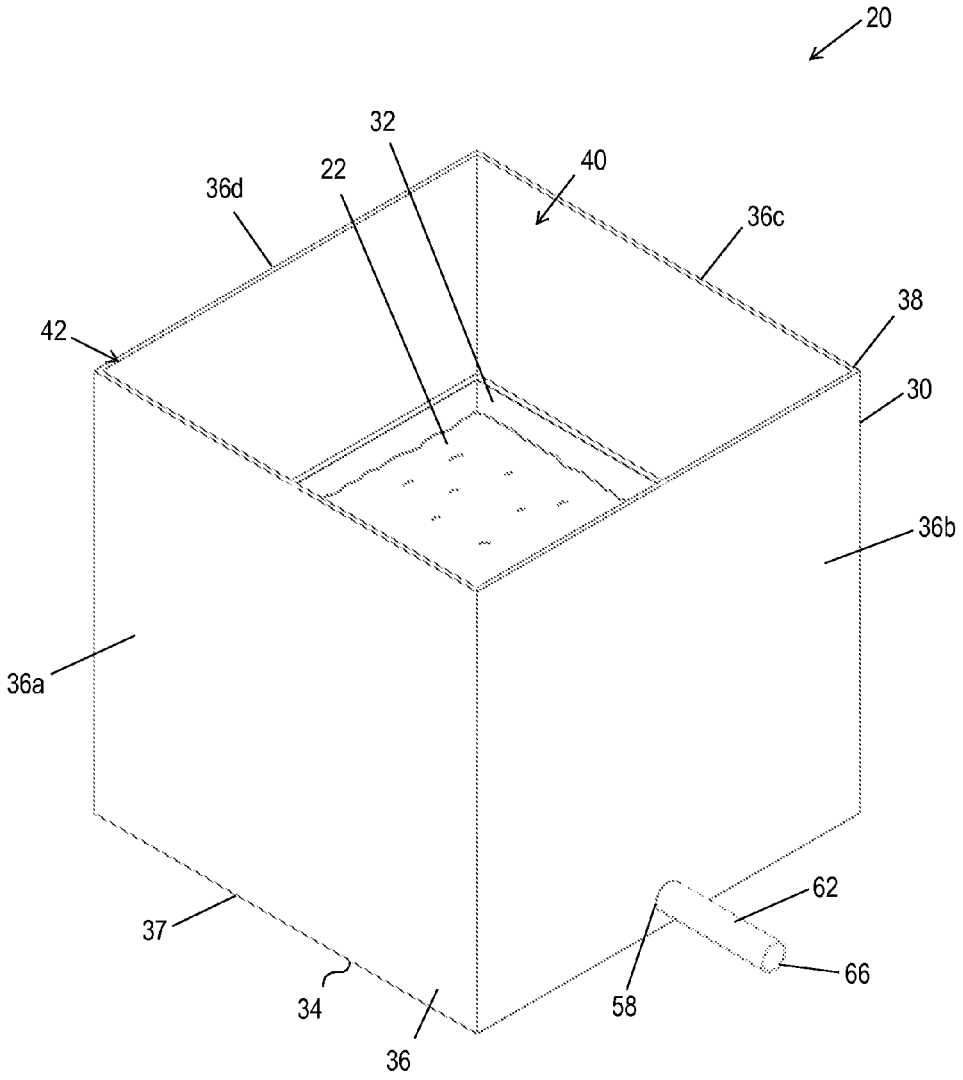
FIG. 1 is an upper perspective view of a shipping container assembly for bulk particulate material in accordance with the present invention, shown with a vacuum tube attachment installed.

Referring now to the drawings and the illustrative embodiments depicted therein, a shipping container assembly 20 used for transporting and storing bulk loads of pelletized, granular, powdered or other particulate material 22 comprises an outer container 30 and an inner hopper or inner container portion or insert 32 (FIGS. 1-5). Outer container 30 may comprise a generally cube-shaped or four-sided rectangular-shaped box or container, while inner hopper or insert 32 is disposed within the outer container and provides a tapered lower surface or bottom of the storage cavity of the shipping container assembly 20, which allows for enhanced unloading or extraction of particulate material disposed in the shipping container assembly, as discussed below.

Outer container 30 includes a lower or bottom element 34, which forms the base of outer container 30. Extending up from and generally vertical to bottom element 34 is a peripheral wall 36 defined by sides 36*a*, 36*b*, 36*c* and 36*d*, which are connected to bottom element 34 along its periphery 37. Together, bottom element 34 and sides 36*a*-36*d* define an inner storage cavity 40 of the outer container 30. Sides 36*a*-36*d* terminate away from bottom element 34 to form a peripheral upper edge 38, which defines an opening 42 to inner storage cavity 40.

Within the peripheral wall 36 of outer container 30 is insert or inner hopper or inner container portion 32. Inner hopper 32 includes a base or bottom portion 44 and a wall 46 defined by sides 46*a*, 46*b*, 46*c* and 46*d*. Sides 46*a*-46*d* extend upward and at an angle 48 from bottom portion 44. Together, bottom portion 44 and sides 46*a*-46*d* of inner hopper 32 define an inner storage cavity 50 that, along with outer container cavity 40, holds material 22. Sides 46*a*-46*d* terminate away from bottom portion 44 at a top edge or portion 52, which defines an opening 54 to inner storage cavity 50. Bottom portion 44 has a smaller cross section than top portion 52 such that side wall 46 is tapered, giving inner hopper 32 a funnel or inverted pyramid shape.

Near the bottom of side 46*b* is a through hole or aperture 56 for dispensing material 22. As can be seen with reference to FIGS. 2 and 3, outer container 30 also includes a through hole or aperture 58 near the bottom of side 36*b* and centered or generally aligned with aperture 56 on an axis 60. A vacuum tube 62 or similar device may be inserted through apertures 58 and 56 and into inner hopper 32 from a position external to container assembly 20. The vacuum tube is connected to a vacuum device or extraction device that is operable to draw the materials into the tube to extract the material from at or near the bottom of the inner cavity 50 of the inner hopper.

As material is removed near bottom portion 44, the tapered sides 46*a*-46*d* of inner hopper 32 allow material 22 to flow under the force of gravity toward aperture 56 and vacuum tube 62. This allows for complete emptying of shipping container assembly 20 without the need for tilt tables or continuous monitoring or adjustment of the location of the end of the vacuum tube. Although shown as extending generally horizontally between the side wall of the outer container and the angled or tapered side wall of the inner hopper, the shipping container assembly may have the aperture of the inner hopper at a lower or bottom part of the base portion, such that the hose may extend generally vertically downward and through the bottom wall of the outer container, such as for connecting to a hose and/or vacuum source below the shipping container.

Figure 3:
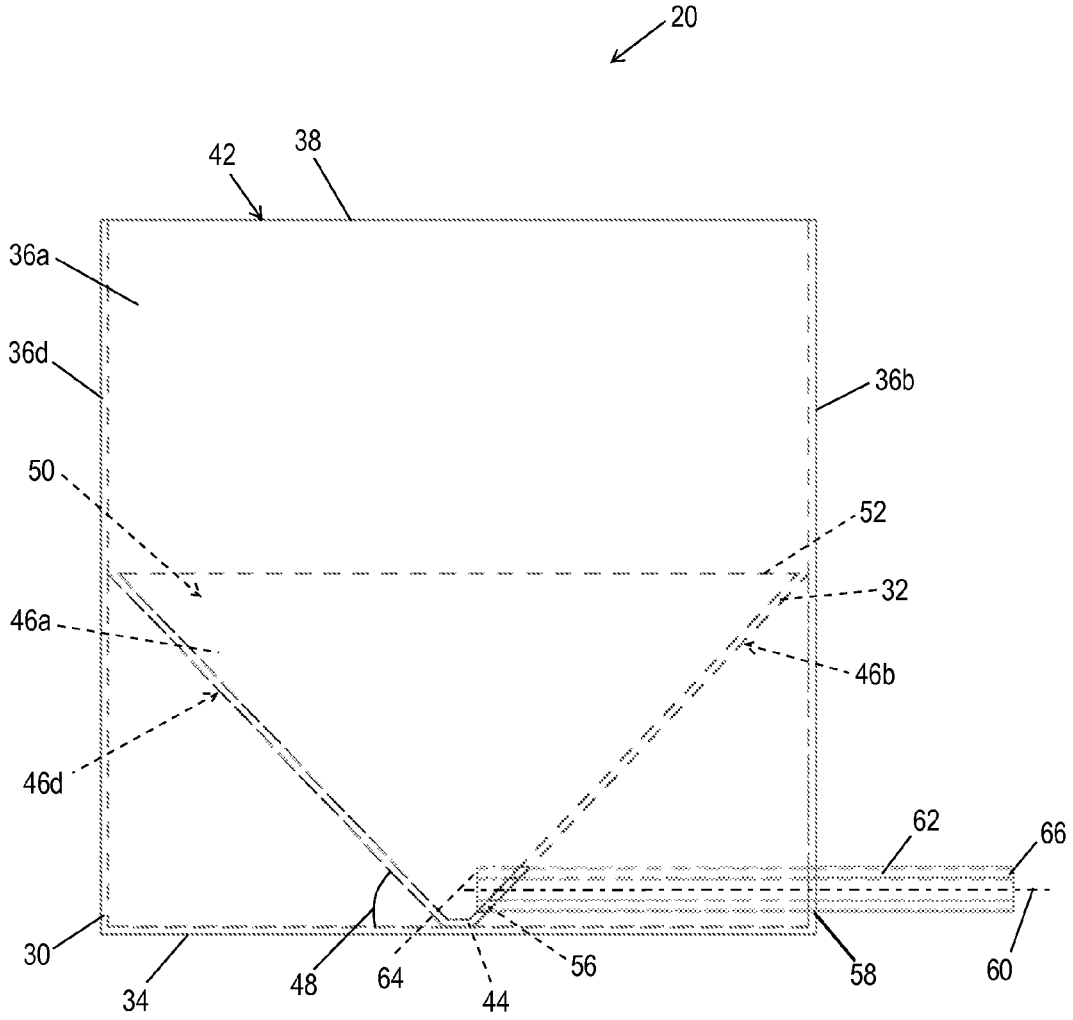
FIG. 3 is a front elevation of the shipping container assembly of FIG. 1.
Figure 4:
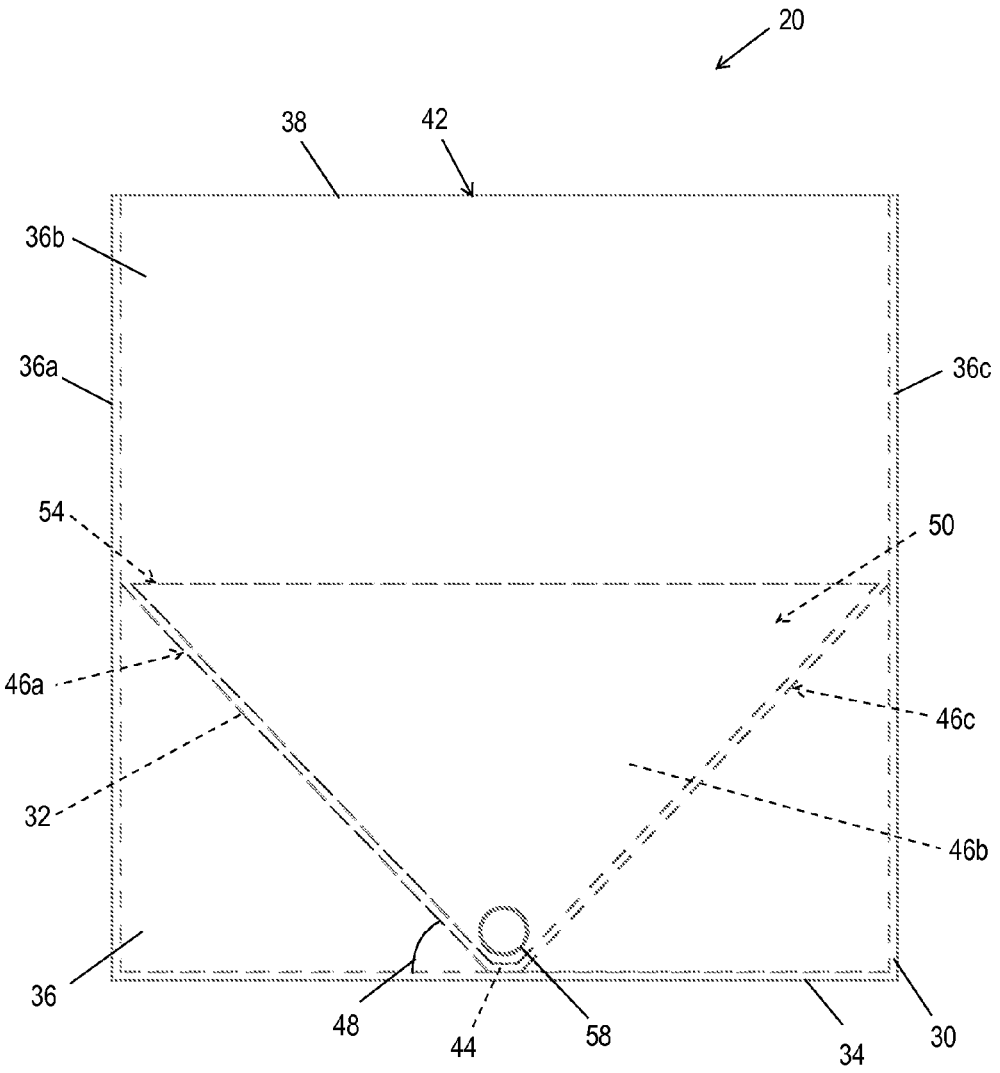
FIG. 4 is a side elevation of the shipping container assembly of FIG. 1.
Figure 5:
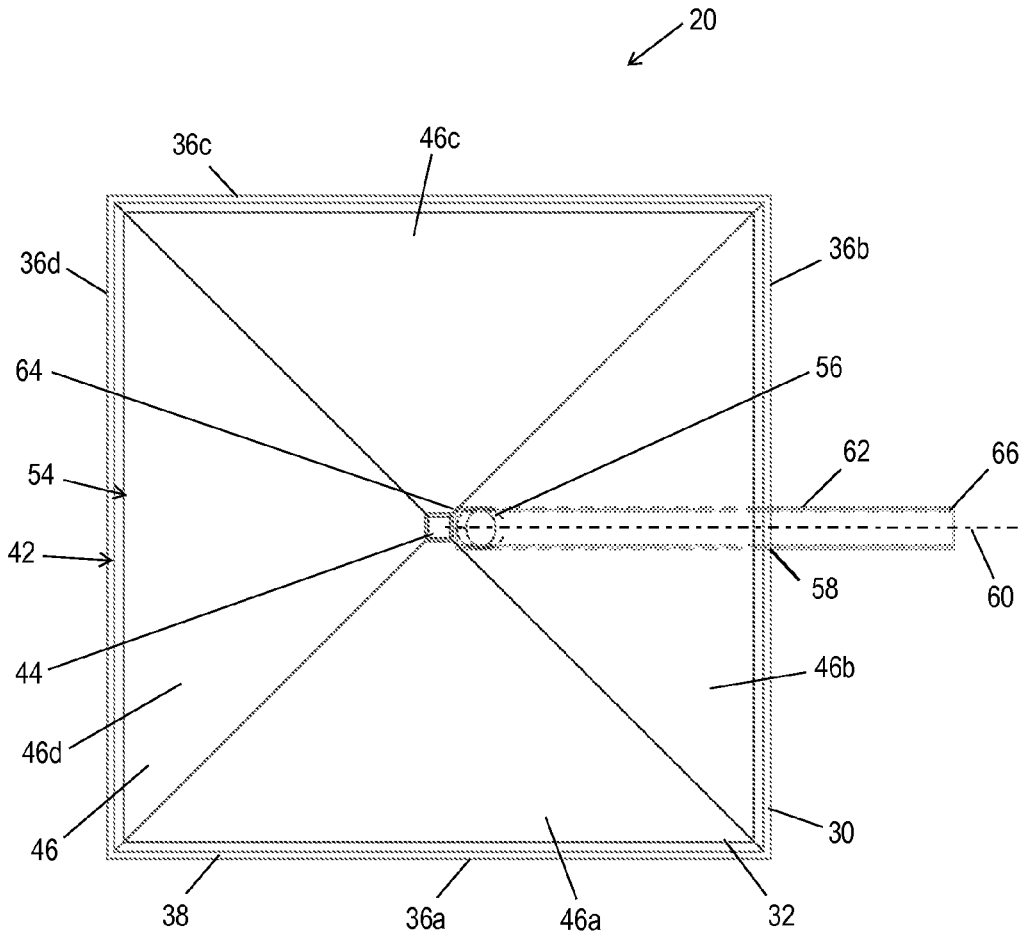
FIG. 5 is a top plan view of the shipping container assembly of FIG. 1.
Figure 6:
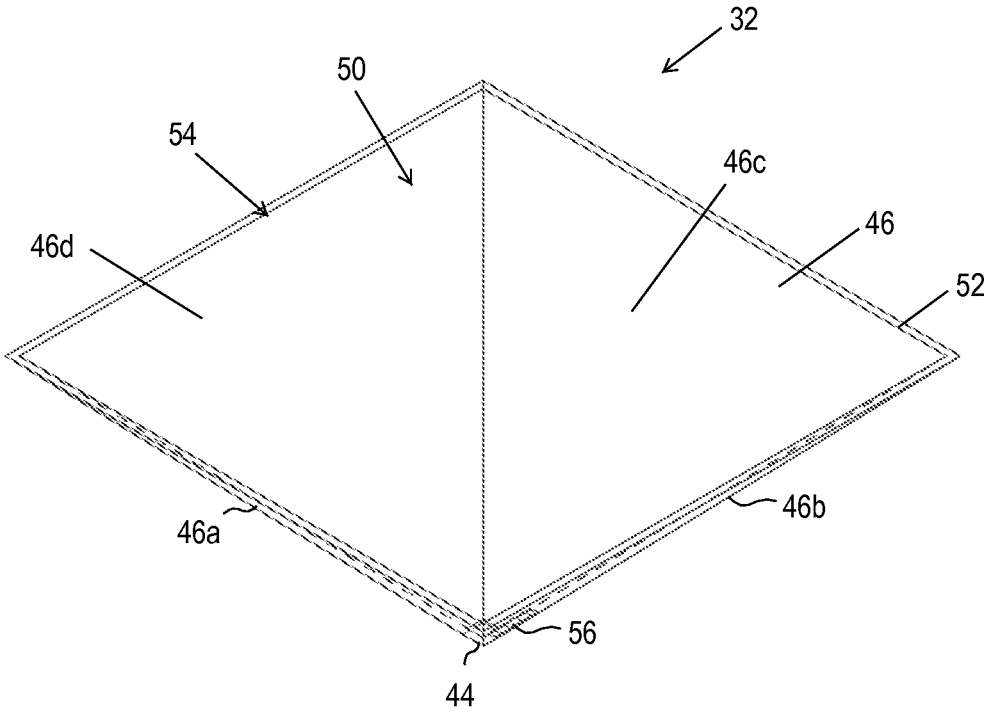
FIG. 6 is an upper perspective view of a shipping container insert or inner hopper in accordance with the present invention.
Figure 7:
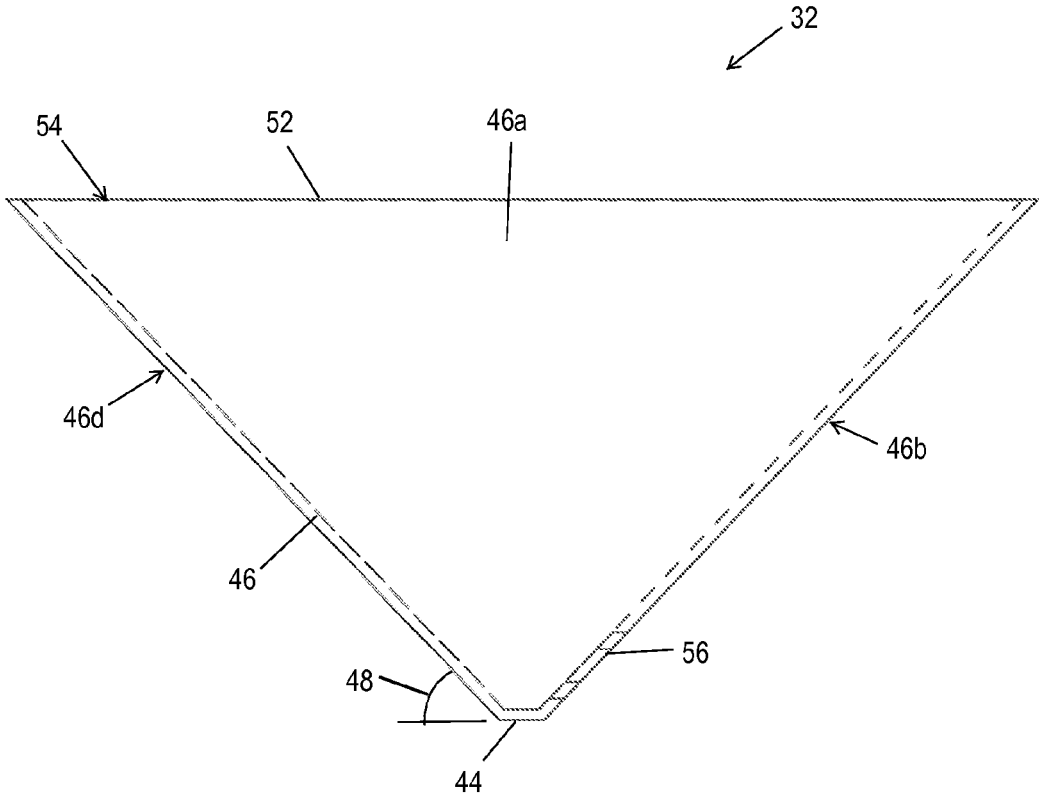
FIG. 7 is a front elevation of the shipping container insert or inner hopper of FIG. 6.
Figure 8:
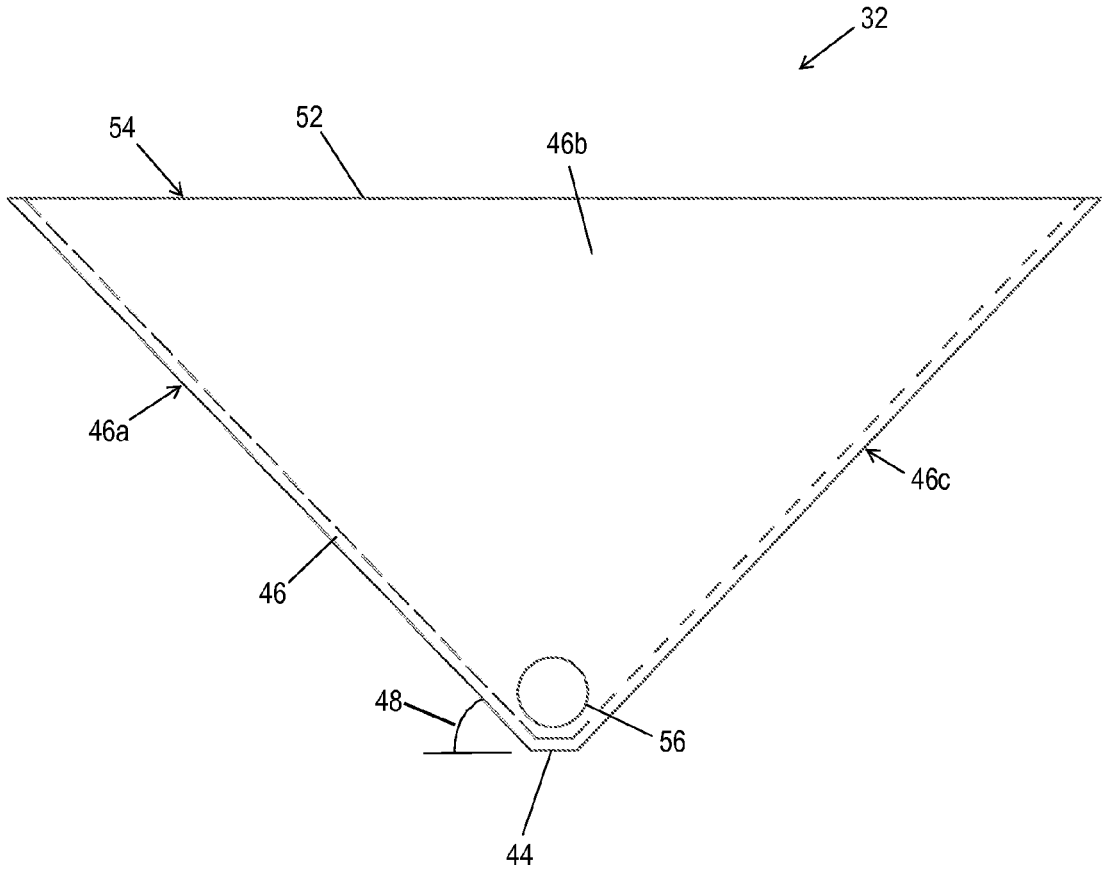
FIG. 8 is a side elevation of the shipping container insert or inner hopper of FIG. 6.
Figure 9:
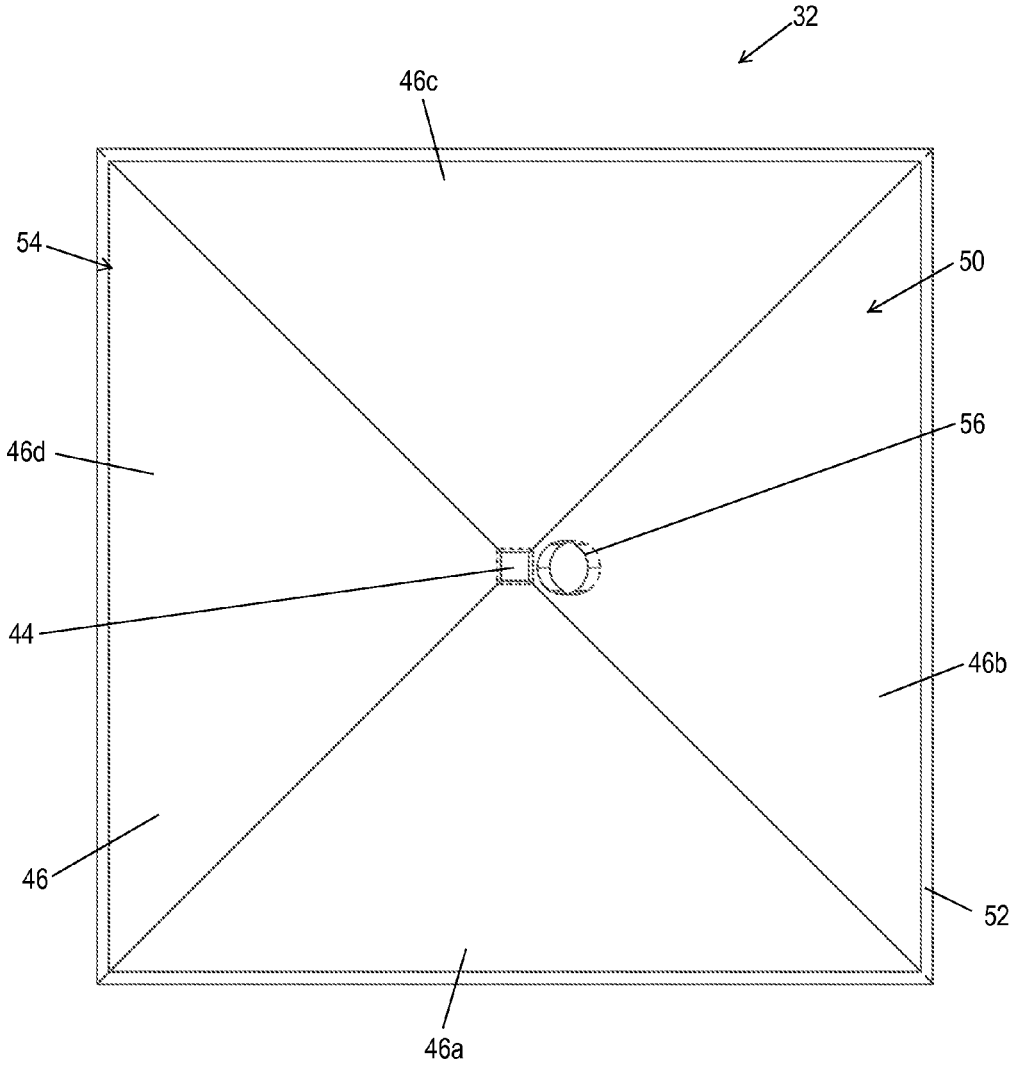
FIG. 9 is a top plan view of the shipping container insert or inner hopper of FIG. 6.
Figure 10:
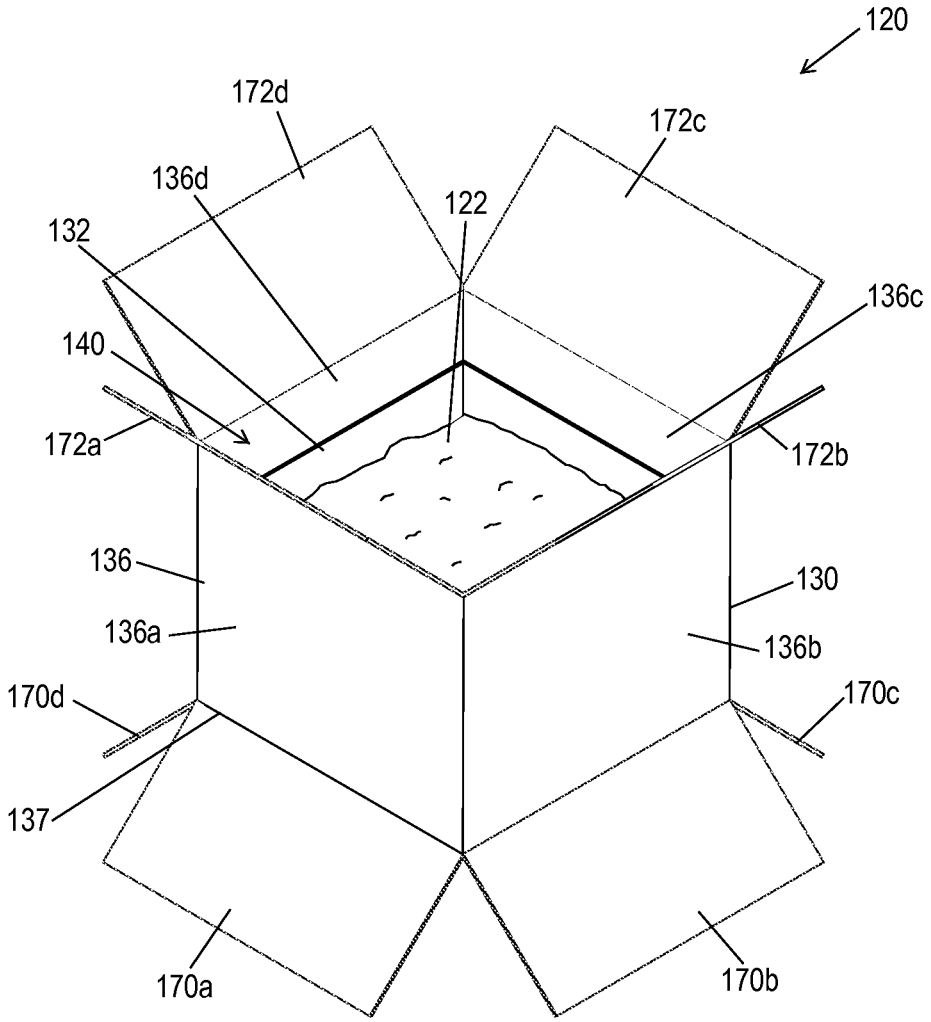
FIG. 10 is an upper perspective view of another bulk particulate shipping container assembly in accordance with the present invention.
Figure 11:
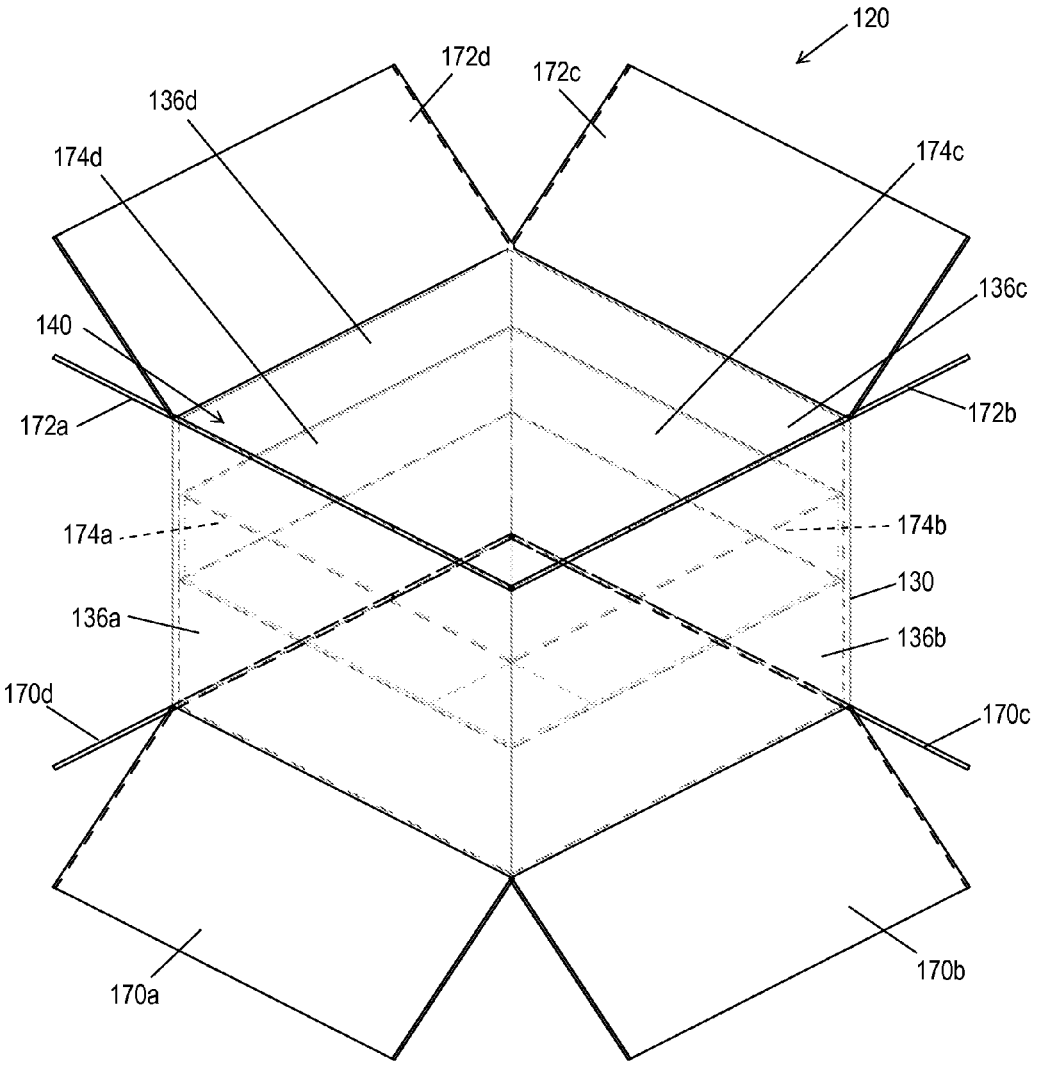
FIG. 11 is another perspective view of the shipping container assembly of FIG. 10, showing internal details.
Figure 12:
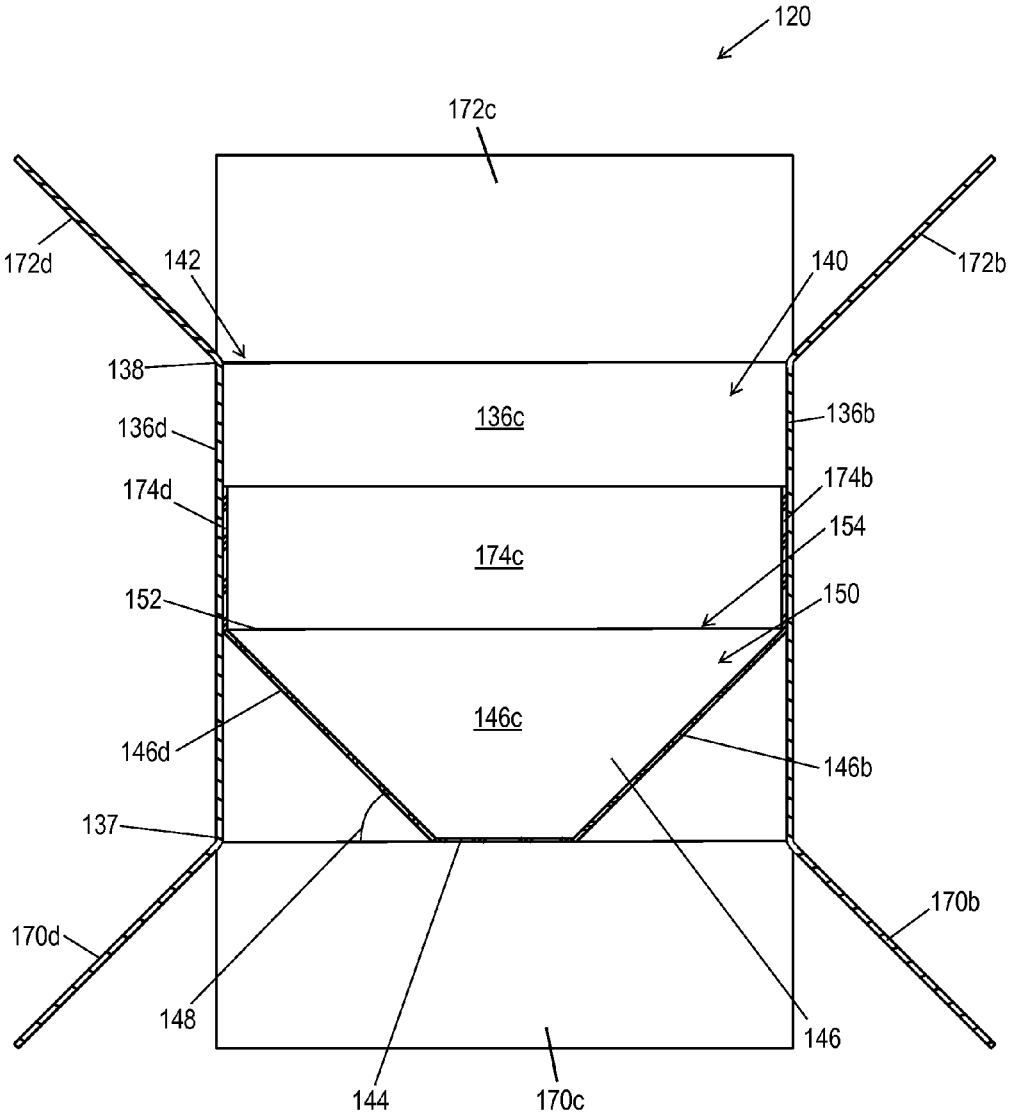
FIG. 12 is a front sectional view of the shipping container assembly of FIG. 10.
Figure 13:
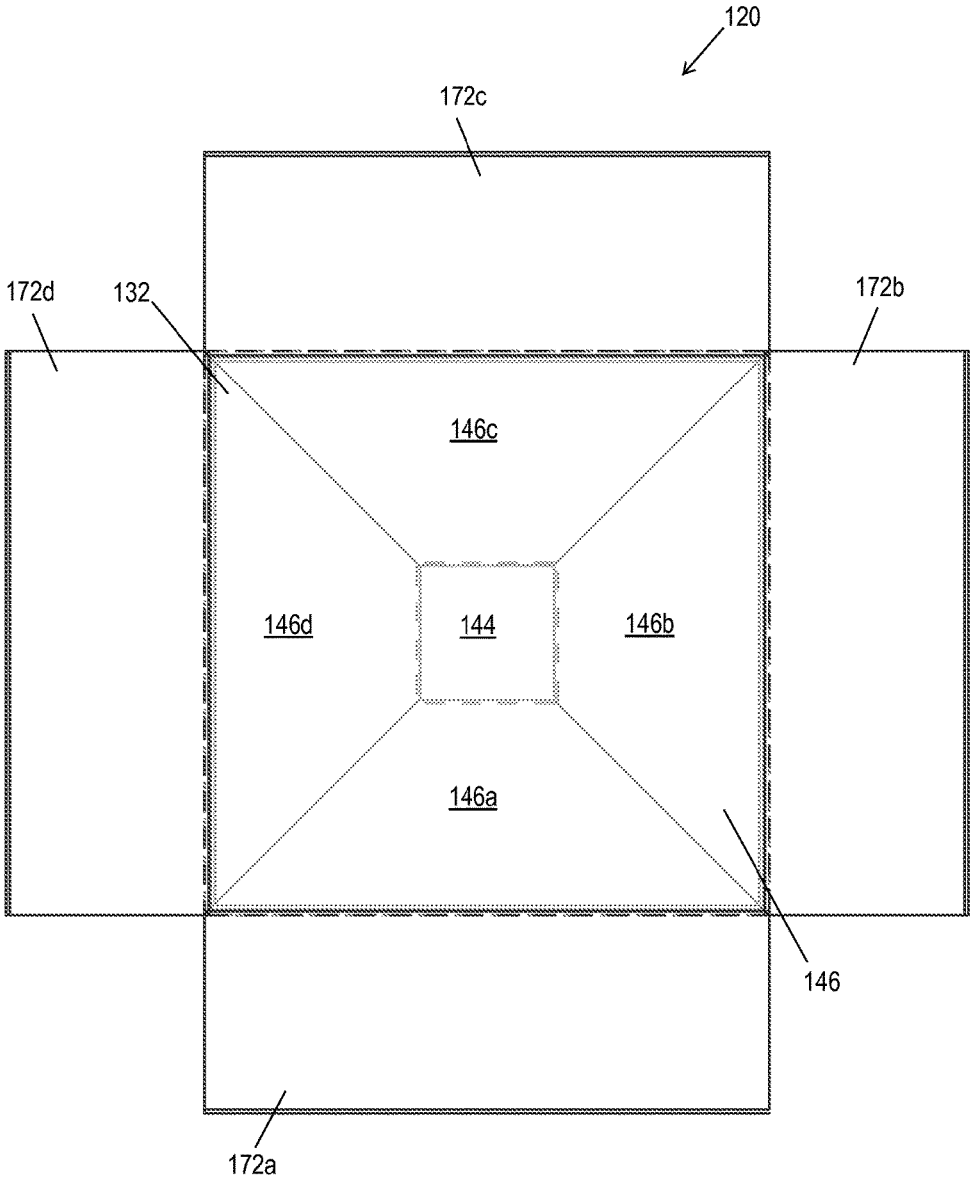
FIG. 13 is a top plan view of the shipping container assembly of FIG. 10.

In the illustrated embodiment, and as best shown in FIGS. 6-9, insert or inner hopper 32 is comprised of wall 46 having four equally sized sides 46*a*-46*d* that are generally trapezoidal in shape and extend upward from bottom portion 44 at angle 48 and terminate at top portion 52. Top portion 52 defines the opening 54 to inner storage cavity 50 of inner hopper 32. Near the bottom of side 46*b*, just above bottom portion 44, is aperture 56. As shown in FIGS. 3-5, sides 46*a*-46*d* of inner hopper 32 are dimensioned so that top portion 52 forms a friction fit with the inner surface of wall 36 while bottom portion 44 rests on or above bottom element 34 when inserted in outer container 30. Optionally, top portion 52 and/or bottom portion 44 may be adhered to outer container 30 through the use of an adhesive or the like (or may be otherwise fastened together, such as via staples or the like). Outer container 30 in combination with inner hopper 32 effectively creates a shipping container with a beveled or funnel-shaped bottom so that particulate material 22 automatically collects at the lower or bottom portion 44 of the inner storage cavity. The shipping container assembly may be provided as an assembled container and insert or inner hopper, or the insert or inner hopper may be provided as an aftermarket element that is inserted into a conventional large shipping container or Gaylord container to enhance extraction of material from the shipping container.

Figure 2:
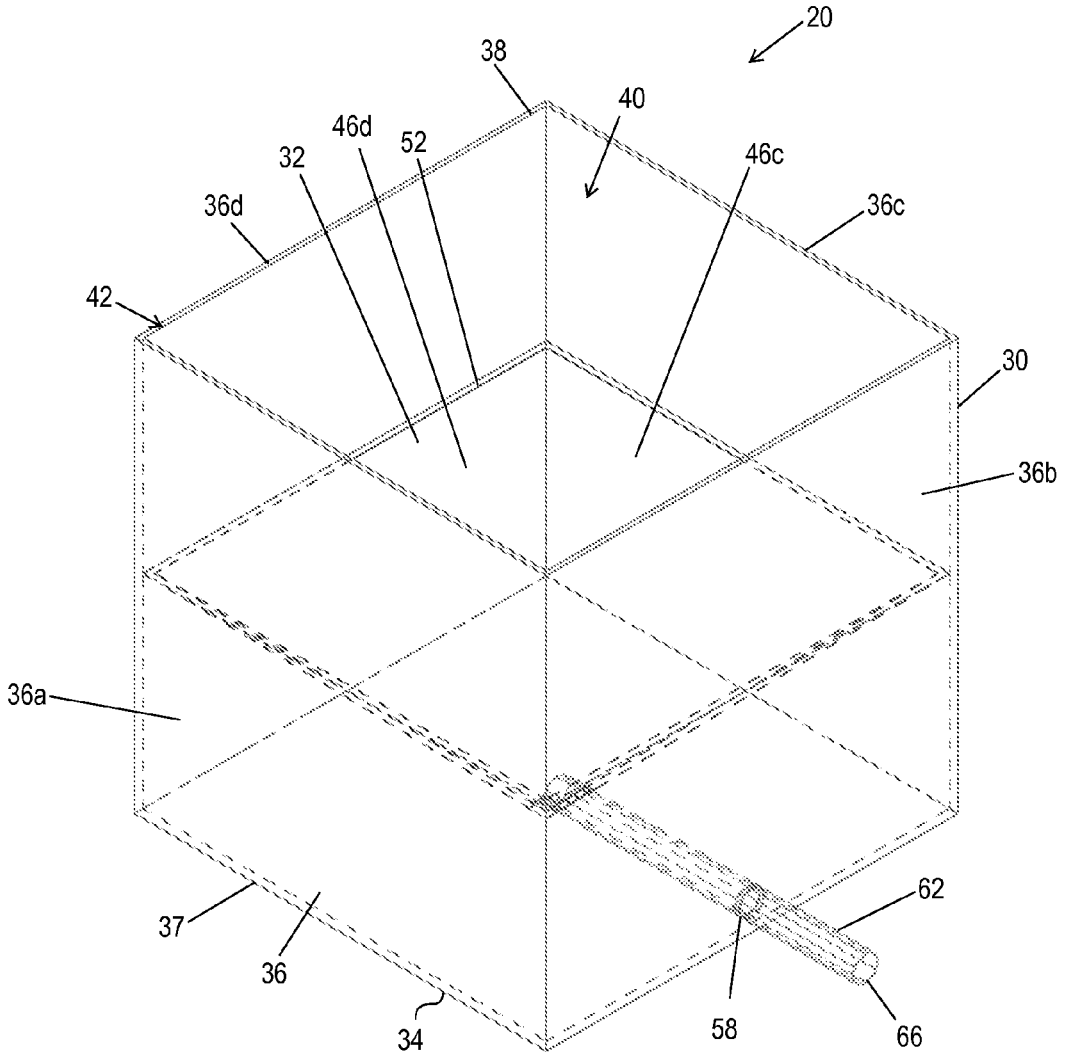
FIG. 2 is another perspective view of the shipping container assembly of FIG. 1, showing internal details.

As shown in FIGS. 1-3, a tube 62 may be inserted into the apertures 56, 58 and at least partially at or into the inner cavity of the insert or inner hopper. Tube 62 can be any vacuum attachment, such as a lance or the like, and is generally cylindrical in shape with a first end 64 and a second end 66. Apertures 56 and 58 are generally circular in shape and centered or generally aligned along axis 60 so that first end 64 of tube 62 may be inserted from the exterior of outer container 30 through aperture 58 and into inner cavity 50 of inner hopper 32 through aperture 56. Tube 62 is of sufficient length that second end 66 remains external to shipping container assembly 20 (and optionally the tube may be part of the container assembly with the outer end of the tube terminating generally at the side wall 36*b* of the outer container 30), whereby a vacuum source (or tube connected to a vacuum source) may be connected to the tube to vacuum or draw or extract particulate material from the container. Optionally, the shipping container assembly may include a plastic fitting or connector at the aperture 56 of inner hopper 32 or aperture 58 of outer container 30, whereby a separate hose or tube may be connected at the connector when the shipping container assembly (with particulate material disposed therein) is at the facility where it is to be unloaded. If the aperture 58 of outer container 30 includes the connector, then a hose or tube is disposed between the connector and the aperture 56 of the inner hopper and is part of the shipping container assembly.

Particulate material 22 can then be removed by attaching the vacuum hose (not shown) to second end 66 and activating the vacuum device. As particulate material 22 is drawn from or removed from the bottom of inner cavity 50 through reduced air pressure created by the vacuum, gravitational forces cause the remaining particulate material to flow downward toward bottom portion 44 to backfill the void created by the emptying material. This funneling effect allows for a complete emptying of the container without the need for human intervention or tipping equipment. When material 22 has been removed, tube 62 may be readily or easily extracted from the container for use on the next shipping container assembly 20 (or the vacuum hose may be disconnected from the tube and the tube may remain as part of the container, depending on the particular configuration and application of the shipping container assembly).

To prevent the loss of material 22 during transport or storage, aperture 56 (or the end of the tube at the outer side wall of the outer container) may be closed or sealed during shipping, such as sealed with a film or foil material that is punctured when tube 62 is inserted (or removed before the tube is connected or inserted). Optionally, aperture 56 may have a perforated perimeter so that a portion of inner hopper 32 may cover aperture 56 and be punched out or broken away by tube 62 when it is inserted. Optionally, insert or inner hopper 32 may have a vacuum port formed at aperture 56, such as a threaded plastic connector or the like, configured to detachably engage with tube 62, allowing for easy vacuum hookup. One skilled in the art will recognize and appreciate the various ways insert or inner hopper 32 may be configured to allow attachment of a vacuum hose for material extraction.

Optionally, a shipping container assembly in accordance with the present invention may be configured to allow for the removal of material using a standard pickup wand or lance inserted through a top opening. For example, and as shown in FIGS. 10-13, a shipping container assembly 120 comprises an outer container 130 and a funnel-like insert or inner container portion or inner hopper 132. Outer container 130 includes four bottom flaps 170*a*, 170*b*, 170*c* and 170*d*, which, when folded inward along peripheral edge 137, form a base for outer container 130. Extending up from and generally vertical to the base is a peripheral wall 136 defined by sides 136*a*, 136*b*, 136*c* and 136*d*. At the upper end or edge of each of sides 136*a*-136*d* is a top flap 172*a*, 172*b*, 172*c* and 172*d*, respectively. When folded together, top flaps 172*a*-172*d* form a top or cover for outer container 130. Together, the base and sides 136*a*-136*d* define an inner storage cavity 140 with an opening 142 defined by a peripheral edge 138 at the intersection of sides 136*a*-136*d* and their corresponding top flaps 172*a*-172*d*.

Within peripheral wall 136 of outer container 130 is inner hopper 132. Insert or inner hopper 132 includes a base or bottom portion 144 and a wall 146 defined by sides 146*a*, 146*b*, 146*c* and 146*d*. Sides 146*a*-146*d* extend upward and at an angle 148 from bottom portion 144, giving inner hopper 132 a funnel or inverted pyramid shape (such as in a similar manner as inner hopper 32, discussed above). Sides 146*a*-146*d* terminate away from bottom portion 144 to form a top edge or portion 152 to wall 146. Together, bottom portion 144 and sides 146*a*-146*d* define an inner storage cavity 150 for holding material 122 and having an opening 154 defined by top portion 152. At the upper region of each of sides 146*a*-146*d* along top portion 152 are tab elements or flaps 174*a*, 174*b*, 174*c* and 174*d*, respectively, which engage the inner surface of the container 130 when inner hopper 132 is disposed therein and which may be used to secure inner hopper 132 to the inner surface of outer container sides 136*a*-136*d*.

In the illustrated embodiment, inner hopper 132 has no aperture near bottom portion 144 for receiving a vacuum wand or tube. Instead, a vacuum wand may be inserted downward and into particulate material 122 via opening 142 until the wand reaches bottom portion 144. As the suction from the vacuum draws material 122 from the bottom of inner hopper 132, gravity causes material 122 from higher areas to flow downward toward bottom portion 144, filling the voids created in material 122. Thus, the hose may substantially or entirely empty the contents from the container without an operator or machine having to move the hose around in the container and without having to tip the container to one side and/or the other.

In the illustrated embodiments, the outer container has a bottom portion that is essentially square in shape having four vertical sides. One such container, which is sometimes referred to as a Gaylord, is made from corrugated cardboard and is sized 48 inches wide by 48 inches high by 48 inches deep. However, it is envisioned that an outer container may be constructed from any number of materials such as, for example, wood, plastic, or metal and may comprise any suitable shape, such as rectangular or cylindrical or non-cylindrical, while remaining within the scope of the present invention. By constructing the container out of cardboard or the like, the container of the present invention may provide a disposable shipping container with enhanced unloading features.

Similarly, the inner hopper or insert is shown having a bottom portion that is essentially square in shape with four angled sides creating an inverted pyramid shape. However, it is envisioned that the inner hopper or insert may comprise any suitable shape or form, such as an inverted cone for example, based on the shape of the outer container. The overall size and shape of the inner hopper or insert is chosen to not only fit within the cavity of the outer container, but also to allow the free flow of material down toward the bottom portion of the inner hopper or insert while minimizing the amount of unutilized shipping space. Because different particulate materials have different size, weight and angle of repose, the overall shape of the inner hopper or insert may be selected depending on the particulate material being shipped.

The inserts or inner hoppers or inner container portions described above are preferably constructed from corrugated cardboard or molded from plastic, but may be constructed from any materials suitable for supporting the weight of the particulate material being shipped. The term "insert", as used herein, is not intended to be limited to a separate part or construction that is inserted into an outer container, but is intended to mean any insertable construction of the types described above and any interiorly formed construction (formed in or established in or formed as part of the container itself) that is established at the interior cavity of the container in a manner such as described herein. For example, the insert or inner hopper or inner container portion may comprise a separate piece or construction that installs into the outer container through friction fit, adhesive, staples, fasteners or the like. Optionally, the insert or inner hopper or inner container portion may be formed as part of the outer container, removing the need for a separate insert element or construction. For example, the outer container or shipping container may be formed of laminated cardboard, and an outer layer or layers of the cardboard material may form the overall rectangular box form, while an inner layer or layers of the cardboard material may separate from the outer layer(s) and angle inward to establish the inner hopper or inner container portion or insert.

Although shown and described as an inverted pyramid shape, such as an inverted truncated pyramid shape, the inner hopper or inner container portion or insert may be formed as any other suitable shape that funnels or guides the particulate material towards an extraction region. For example, instead of having four walls taper towards a generally central extraction region, the inner hopper or inner container may have two or three walls taper towards an extraction region located generally at or near a non-tapering wall of the outer container, whereby, if desired, a vacuum hose or tube may be disposed at the non-tapered wall of the outer container to draw the particulate material from the container assembly as it flows down the tapered walls towards the extraction region. In such a configuration, if the inner hopper comprises a separate construction that is inserted into the larger outer container, the separate inner hopper construction may comprise a three-sided construction (where the inner hopper uses the non-tapered wall of the container as one of its sidewalls when the inner hopper is disposed in the container) or a four-sided construction (where a non-tapered wall of the inner hopper extends along the non-tapered wall of the container when the inner hopper is disposed in the container). Other shapes and forms of the inner hopper or insert or inner container portion may be implemented while remaining within the spirit and scope of the present invention.

Therefore, the present invention provides a shipping container and inner hopper or inner container portion or insert for use in transporting bulk particulate material that overcomes the drawbacks of the prior art. The inner hopper provides a beveled bottom so that the particulate material flows to a central point as material is removed. This eliminates the need for continual monitoring by an operator or costly tipping machines. Further, because the inner hopper or insert may be part of the shipping container, it can be made from inexpensive material that can be recycled or discarded after use.

Changes and modifications to the specifically described embodiments may be carried out without departing from the principles of the present invention, which is intended to be limited only by the scope of the appended claims as interpreted according to the principles of patent law including the doctrine of equivalents.

The invention claimed is:

1. A shipping container assembly for transporting bulk particulate material comprising: an outer container having an outer container storage cavity defined by an outer container base element and an outer container wall extending upward from said outer container base element, wherein said outer container comprises an integral construction; an inner container having an inner storage cavity at least partially defined by an inner container base portion and an inner container wall extending upward from said inner container base portion, wherein said inner container wall terminates at a peripheral edge that defines an inner container opening to said inner storage cavity, and wherein said inner container base portion has a smaller cross section than said inner container opening such that said inner container wall is tapered; wherein said outer and inner containers each comprise a construction of cardboard material; wherein said inner container is configured to fit within said outer container storage cavity of said outer container so that said peripheral edge of said inner container wall contacts said outer container wall; wherein, when said inner container is disposed in said outer container, said tapered inner container wall provides a lower surface of said outer container storage cavity; wherein said inner container has the shape of an inverted truncated pyramid; and wherein said inner container further includes one or more tabs extending from said peripheral edge, and wherein said tabs are configured to secure said inner container to said outer container wall.

2. A shipping container insert for containing particulate material, said shipping container insert comprising:

a base portion;

a wall extending upward and away from said base portion and having a peripheral edge, wherein said base portion and said wall define an inner storage cavity, and wherein said peripheral edge defines an opening to said inner storage cavity, and wherein said base portion has a smaller cross section than said opening such that said wall is tapered;

attachment flaps extending from said peripheral edge of said wall, wherein said attachment flaps comprise outer surfaces that are configured for attachment at a wall of an outer shipping container when said shipping container insert is disposed in said outer shipping container; and wherein said base portion and said wall of said shipping container insert comprise an integral construction that comprises a cardboard material.

3. The shipping container insert of claim 2, wherein said walls are configured in the shape of an inverted pyramid.

4. The shipping container insert of claim 2, wherein said insert includes an aperture extending through said wall at a lower region of said wall at or near said base portion.

5. The shipping container insert of claim 4, wherein said aperture includes a connector configured to detachably engage a vacuum tube for drawing particulate material out of said insert through said aperture.

* * * * *